US010655414B1

(12) United States Patent
Wang et al.

(10) Patent No.: US 10,655,414 B1
(45) Date of Patent: May 19, 2020

(54) SYSTEM AND METHOD FOR IMPROVING INTEGRITY OF CASED WELLBORES

(71) Applicants: HanYi Wang, Austin, TX (US); PeiDong Zhao, Austin, TX (US)

(72) Inventors: HanYi Wang, Austin, TX (US); PeiDong Zhao, Austin, TX (US)

( * ) Notice: Subject to any disclaimer, the term of this patent is extended or adjusted under 35 U.S.C. 154(b) by 0 days.

(21) Appl. No.: 16/693,224

(22) Filed: Nov. 23, 2019

Related U.S. Application Data

(60) Provisional application No. 62/792,834, filed on Jan. 15, 2019.

(51) Int. Cl.
*E21B 29/10* (2006.01)
*E21B 49/00* (2006.01)
*E21B 7/28* (2006.01)

(52) U.S. Cl.
CPC ..... *E21B 29/10* (2013.01); *E21B 7/28* (2013.01); *E21B 49/006* (2013.01)

(58) Field of Classification Search
CPC ..... E21B 29/00; E21B 29/10; E21B 7/28
See application file for complete search history.

(56) References Cited

U.S. PATENT DOCUMENTS

| | | | | |
|---|---|---|---|---|
| 8,561,722 | B2 | 10/2013 | Parlin | |
| 9,322,949 | B2 | 4/2016 | Mosse et al. | |
| 9,546,548 | B2 | 1/2017 | Hartog et al. | |
| 2002/0189816 | A1 | 12/2002 | Cook et al. | |
| 2007/0012456 | A1 | 1/2007 | Cook et al. | |
| 2015/0152704 | A1* | 6/2015 | Tunget | E21B 33/128 166/254.2 |
| 2018/0156759 | A1 | 6/2018 | Lei et al. | |

* cited by examiner

*Primary Examiner* — Robert E Fuller
(74) *Attorney, Agent, or Firm* — Kanika Radhakrishnan; Evergreen Valley Law Group

(57) ABSTRACT

A system and method for improving integrity of a cased wellbore. The method comprises identifying at least one weak plane corresponding to a highest probability of slip of fault within the open-hole wellbore. Further, the method comprises providing pressurized fluid into the open-hole wellbore to cause the slip of the fault by inducing tensile or shear failures within the open-hole wellbore along the at least one weak plane. The method also comprises restoring a shape of the open-hole wellbore after the slip of the fault by removing material from an inner surface of the open-hole wellbore, to provide a uniform or smooth cross-section along an elongate axis of the open-hole wellbore. The method further comprises arranging and cementing a casing along the restored open-hole wellbore to obtain the cased wellbore having improved integrity.

20 Claims, 6 Drawing Sheets

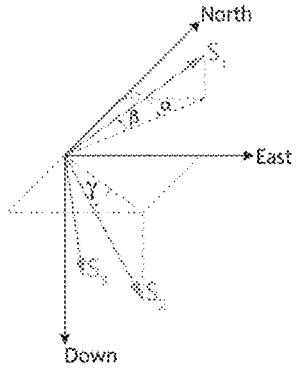

$$\bar{\bar{\sigma}} = \begin{bmatrix} \sigma_1 & 0 & 0 \\ 0 & \sigma_2 & 0 \\ 0 & 0 & \sigma_3 \end{bmatrix}$$

$$\overline{\overline{R_g}} = \begin{bmatrix} \cos\alpha\cos\beta & \sin\alpha\cos\beta & -\sin\beta \\ \cos\alpha\sin\beta\sin\gamma - \sin\alpha\cos\gamma & \sin\alpha\sin\beta\sin\gamma + \cos\alpha\cos\gamma & \cos\beta\sin\gamma \\ \cos\alpha\sin\beta\cos\gamma + \sin\alpha\sin\gamma & \sin\alpha\sin\beta\cos\gamma - \cos\alpha\sin\gamma & \cos\beta\cos\gamma \end{bmatrix}$$

$$\overline{\overline{\sigma_g}} = \overline{\overline{R_g}}^T \bar{\bar{\sigma}}\, \overline{\overline{R_g}}$$

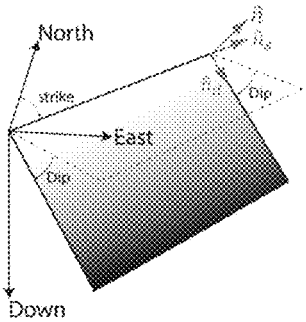

$$\hat{n} = \begin{bmatrix} -\sin(strike)\sin(dip) \\ \cos(strike)\sin(dip) \\ -\cos(dip) \end{bmatrix};\ \hat{n}_s = \begin{bmatrix} \cos(strike) \\ \sin(strike) \\ 0 \end{bmatrix};\ \hat{n}_d = \begin{bmatrix} -\sin(strike)\cos(dip) \\ \cos(strike)\cos(dip) \\ \sin(dip) \end{bmatrix}$$

$$\bar{t} = \overline{\overline{\sigma_g}} \cdot \hat{n}$$

$$\sigma_n = \bar{t}^T \cdot \hat{n}$$

$$\tau_d = \bar{t}^T \cdot \hat{n}_d;\ \tau_s = \bar{t}^T \cdot \hat{n}_s;\ \tau = \sqrt{\tau_d^2 + \tau_s^2}$$

FIG. 7

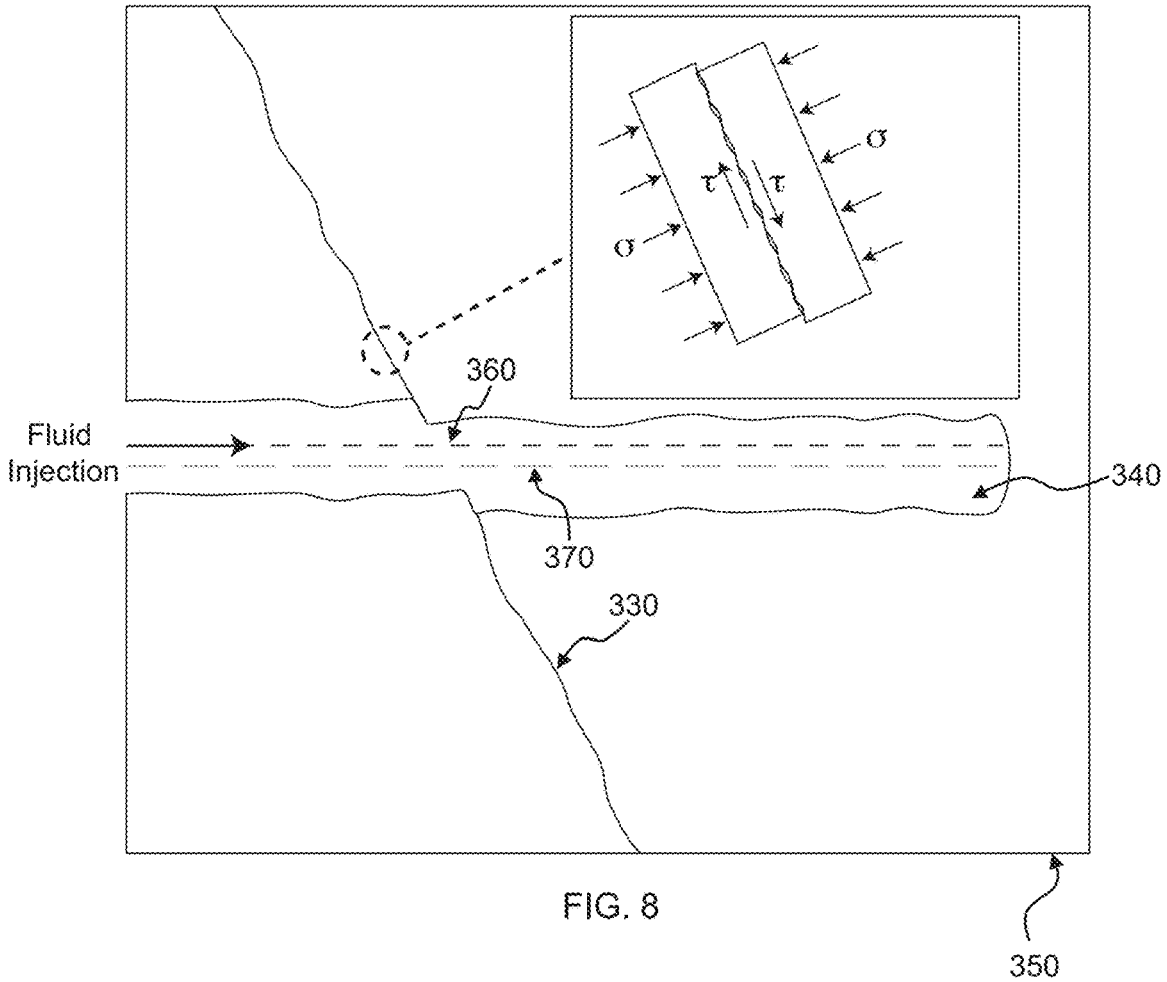

FIG. 8

SYSTEM AND METHOD FOR IMPROVING INTEGRITY OF CASED WELLBORES

FIELD OF THE PRESENT DISCLOSURE

The present disclosure relates to hydraulic fracturing and, more particularly to methods and systems for improving integrity of cased wellbores.

BACKGROUND

Hydraulic fracturing is a standard practice in stimulating production of hydrocarbon products from hydrocarbon reservoirs. During hydraulic fracturing treatment, pressurized fluids are injected into a wellbore to overcome a breaking strength of rock. Consequently, one or more hydraulic fractures are initiated that subsequently propagate away from the wellbore into the reservoir until fluids injection stops. Eventually, the created hydraulic fractures serve as conductive pathways through which hydrocarbon products migrate en route to the wellbore and are brought up to the surface. Hydraulic fracturing has also been applied for preventing sand production in unconsolidated rock formations and for stimulating heat extraction from geothermal system.

Hydraulic fracturing is commonly executed in cased wellbores. A cased wellbore is constructed first by drilling a borehole (known as an open-hole wellbore) to a target depth. Then, steel casing is arranged and placed in the borehole and an outside of the casing is bonded with the borehole using cement. After the casing is cemented (i.e., open-hole wellbore is made into cased wellbore), downhole tools (e.g., perforation guns) are used to create holes at a wall of the wellbore that penetrates the casing, cement sheath, and some distance into the rock formation associated with a reservoir (or reservoir rock). The purpose of perforating the cased wellbore is to establish hydraulic communication between reservoir rock and the cased wellbore. Finally, the cased wellbore or a portion thereof is hydraulically fractured by injecting pressurized fluid.

Pre-existing weak planes are common features of geological formations, exhibited in a variety of forms. The weak plane is formed through brittle failure of rock mass as a result of tectonic movement. It is well-understood that the rocks containing interlocked or weakly bonded planes have weaker strengths than rock formations lacking such an interface. Correspondingly, the plane serves as a preferential plane of failure. As such, the interlocked or weakly bonded plane is often called weak plane. Besides, the failure of the weak plane is governed by frictional contact of the surfaces, and slip (or shear movement parallel to the surfaces) occurs upon reaching a critical condition. Typical forms of weak planes are joints and faults. Despite having a similar origin as faults, the joints are also called natural fractures. However, both forms may consist of multiple fractures with specific dominating strike and dip orientations. For clarity purposes, "fault" is used herein as a generalized term representing all types of pre-existing weak planes in the subsurface.

The slip of the fault (also referred as fault reactivation) can be detrimental to wellbore integrity under some extreme circumstances. In hydraulic fracturing or water injection operations, seismic monitoring is performed to capture the seismic event generated during shear slip of weak planes. If the observed seismic events occur at small magnitudes (i.e., classified as micro-seismic event) and far away from wellbores, the wellbore system composed of casing and cement sheath is capable to sustain such mechanical loading induced by the slip of weak planes. However, field observations have shown that in some tectonically active regions, if the wellbore is drilled through a fault and the induced slip is greater than a certain magnitude (such as, a few centimeters), the slip can lead to severe deformation of a steel casing that is cemented inside a wellbore. This leads to the distortion of casing geometry, resulting obstruction inside casing along the wellbore pathway that makes subsequent downhole operations impossible. This further brings environmental and safety concerns over the risk of wellbore integrity during the lifetime of the wellbore. Currently, no viable approaches are available that can effectively reduce the risk of fault reactivation induced casing damage during hydraulic fracturing once the casing is cemented inside a wellbore.

Based on above description, methods and tools for mitigating fault reactivation induced casing damage for cased wellbore are desired, especially methods and tools that are compatible with current field practices and procedures.

SUMMARY

In an aspect, a method for improving integrity of a cased wellbore is provided. The method comprises identifying at least one weak plane corresponding to a highest probability of a slip of a fault within an open-hole wellbore before the casing is cemented. Further, the method comprises providing pressurized fluid into the open-hole wellbore to cause the slip of the fault by inducing tensile or shear failures within the open-hole wellbore along the at least one weak plane. The method also comprises restoring a shape of the open-hole wellbore after the slip of the fault by removing material from an inner surface of the open-hole wellbore, to provide a uniform or smooth cross-section along an elongate axis of the open-hole wellbore. The method further comprises arranging and cementing a casing along the restored open-hole wellbore to obtain the cased wellbore having improved integrity.

In one or more embodiments, the open-hole wellbore is a horizontal wellbore or a deviated wellbore having a non-vertical portion.

In one or more embodiments, the method further comprises predicting an occurrence of the slip of the fault within the open-hole wellbore.

In one or more embodiments, the method further comprises identifying a shear strength along the at least one weak plane and determining a shear stress applied along the at least one weak plane. In such embodiments, the method also comprises determining the shear stress to be equal to or more than the shear strength for predicting the occurrence of the slip of the fault along the at least one weak plane.

In one or more embodiments, the method further comprises using shear failure criterion comprising Mohr-Coulomb failure criterion, for predicting the occurrence of the slip of the fault by identifying a critical pore pressure along the at least one weak plane and determining a pore pressure applied along the at least one weak plane. In such embodiments, the method also comprises determining the pore pressure to be equal to or more than the critical pore pressure for predicting the occurrence of the slip of the fault along the at least one weak plane.

In one or more embodiments, the method further comprises determining an offset between the elongate axis of the open-hole wellbore and an axis corresponding to a distortion caused by the slip of the fault.

In one or more embodiments, restoring the shape of the open-hole wellbore comprises reducing the offset between the elongate axis of the open-hole wellbore and the axis corresponding to the distortion caused by the slip of the fault.

In another aspect, a system for improving integrity of a cased wellbore is provided. The system comprises a data storing arrangement configured to store information corresponding to at least one weak plane within the open-hole wellbore before a casing is cemented into an open-hole wellbore. The system further comprises a data processing arrangement communicatively coupled to the data storing arrangement. The data processing arrangement is configured to receive information corresponding to at least one weak plane within the open-hole wellbore from the data storing arrangement and identify at least one weak plane corresponding to a highest probability of a slip of a fault within the open-hole wellbore. The system also comprises a fluid injection facility configured to provide pressurized fluid into the open-hole wellbore to cause the slip of the fault by inducing tensile or shear failures within the open-hole wellbore along the at least one weak plane. The system further comprises a material-removal device configured to restore a shape of the open-hole wellbore after the slip of the fault by removing material from an inner surface of the open-hole wellbore, to provide a uniform or smooth cross-section along an elongate axis of the open-hole wellbore. The system further comprises devices to arrange and cement the casing along the restored open-hole wellbore to obtain the cased wellbore having improved integrity.

In one or more embodiments, the data processing arrangement is further configured to predict an occurrence of the slip of the fault within the open-hole wellbore.

In one or more embodiments, the data processing arrangement is configured to predict the occurrence of the slip of the fault by identifying a shear strength along the at least one weak plane. Further, the data processing arrangement is configured to determine a shear stress applied along the at least one weak plane. The data processing arrangement is also configured to determine the shear stress to be equal to or more than the shear strength for predicting the occurrence of the slip of the fault along the at least one weak plane.

In one or more embodiments, the data processing arrangement is configured to use shear failure criterion comprising Mohr-Coulomb failure criterion, for predicting the occurrence of the slip of the fault by identifying a critical pore pressure along the at least one weak plane and determining a pore pressure applied along the at least one weak plane. Further, the data processing arrangement is configured to determine the pore pressure to be equal to or more than the critical pore pressure for predicting the occurrence of the slip of the fault along the at least one weak plane.

In one or more embodiments, the fluid injection facility comprises at least one of a perforating gun or a notch tool.

In one or more embodiments, the material-removal device is configured to restore the shape of the open-hole wellbore by performing consecutive forward and backward motions along the elongate axis of the open-hole wellbore.

In one or more embodiments, the data processing arrangement is further configured to determine an offset between the elongate axis of the open-hole wellbore and an axis corresponding to a distortion caused by the slip of the fault.

In one or more embodiments, the material-removal device is configured to restore the shape of the open-hole wellbore by reducing the offset between the elongate axis of the open-hole wellbore and the axis corresponding to the distortion caused by the slip of the fault.

In one or more embodiments, the material-removal device comprises at least one of a milling device, a reaming device, a water-jet device, a gas-jet device or a high-power laser.

In one or more embodiments, the material-removal device is arranged with a self-guiding arrangement for allowing steady movement of the material-removal device within the open-hole wellbore along a planned trajectory.

In one or more embodiments, the material-removal device is further configured to enlarge a diameter of the open-hole wellbore after restoring the shape of the open-hole wellbore.

In yet another aspect, computer program product is provided. The computer program product comprises one or more computer readable hardware storage devices having computer readable program code stored therein, said program code containing instructions executable by one or more processors of a computer system to implement a method for improving integrity of a cased wellbore. The method comprises identifying at least one weak plane corresponding to a highest probability of a slip of a fault within an open-hole wellbore and providing pressurized fluid into the open-hole wellbore to cause the slip of the fault by inducing tensile or shear failures within the open-hole wellbore along the at least one weak plane. The method further comprises restoring a shape of the open-hole wellbore after the slip of the fault by removing material from an inner surface of the open-hole wellbore, to provide a uniform or smooth cross-section along an elongate axis of the open-hole wellbore. The method further comprises arranging and cementing a casing along the restored open-hole wellbore to obtain the cased wellbore having improved integrity.

The system and method of the present disclosure relate to improving safety within cased wellbores by preventing the slip of the fault therein. The present system and method can be employed when extracting/injecting fluid at various subterranean rock formations for accessing hydrocarbon reservoirs. More particularly, but not by way of limitation, the system and method enable us to mitigate damage to a wellbore casing that may result from the slip of the fault during hydraulic fracturing or water injection operations. The system and method enable us to improve the integrity of the cased wellbore by purposely releasing elastic energy stored within the rock formations before a casing is cemented within the open-hole wellbore, which mitigates a risk of the slip of the fault during hydraulic fracturing or water injection processes after the casing is cemented. Further, the present system and method enable us to lessen a magnitude of the slip of the fault and/or mechanical loadings on the wellbore casing even if the slip of the fault occurs subsequently. Thus, the system and method enable us to reduce component damage resulting from slip of faults within cased wellbores, leading to improvement in operation costs and profitability associated with hydraulic fracturing or water injection processes, such as, extraction of hydrocarbon products stored in hydrocarbon reservoirs.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

Advantages of the present invention may become apparent to those skilled in the art with the benefit of the following detailed description and upon reference to the accompanying drawings in which:

FIG. 7 illustrates a technique of calculating normal stress and shear stress acting on a fault plane, in accordance with one or more embodiments of the present disclosure. An upper part of FIG. 7 shows a stress transformation from principle coordinate to geographic coordinate and a lower part of FIG. 7 demonstrates stress tensor transformation from geographic coordinate to fault coordinate. Double bar denotes the second order tensor, arrow head denotes the unit vector, single bar denotes the vector, and variable without label is a scale value.

FIG. 8 depicts a schematic illustration of a cross-section of a slip of a fault due to pre-faulting in an open-hole within a rock formation, in accordance with one or more embodiments of the present disclosure;

Figure 1:
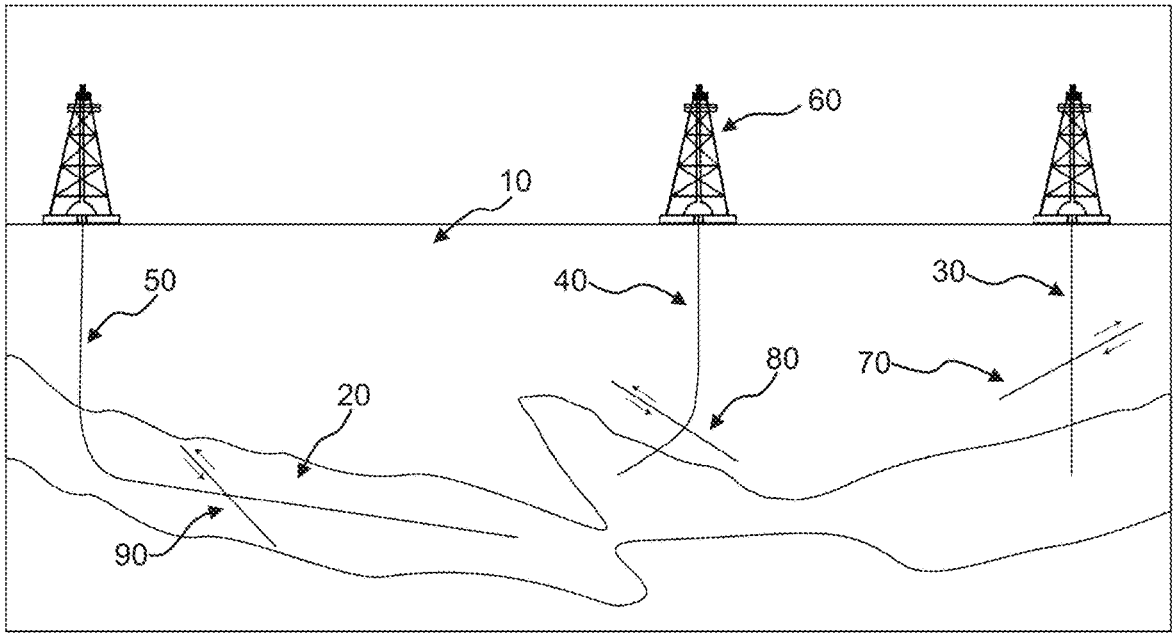
FIG. 1 depicts a schematic illustration of a system for producing fluids from a rock formation or injecting fluids into the rock formation, in accordance with one or more embodiments of the present disclosure.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

In the following description, for purposes of explanation, numerous specific details are set forth in order to provide a thorough understanding of the present disclosure. It will be apparent, however, to one skilled in the art that the present disclosure is not limited to these specific details.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification is not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others. Similarly, various requirements are described which may be requirements for some embodiments but not for other embodiments.

The following description generally relates to systems and methods for improving integrity of cased wellbores. Such systems and methods find application while treating hydrocarbons in rock formations. The rock formations may be treated to yield hydrocarbon products and other products.

A "fluid" may be, but is not limited to, a gas, a liquid, an emulsion, a slurry, and a stream of solid particles that has flow characteristics similar to liquid flow. For example, the fluid can include water-based liquids having chemical additives. Further, the chemical additives can include, but are not limited to, acids, gels, potassium chloride, surfactants, and so forth.

A "formation" includes rock formations comprising one or more layers containing hydrocarbon, one or more non-hydrocarbon layers, an overburden, and an underburden.

A "reservoir" is a porous and permeable rock formation at subsurface that acts as a storage space for fluids. These fluids may be water, hydrocarbons or gas. The reservoirs comprise spaces within rock formations that may have been formed naturally (such as, due to erosion, tectonic movement and so forth) or spaces that may have been formed due to human activities (such as, mining activities, construction activities and the like).

A "wellbore" refers to a hole in a rock formation made by drilling or insertion of a conduit into the formation. The wellbore can be employed for injecting fluids into the rock formation comprising the wellbore, such as, for extracting hydrocarbon products from the rock formation. Generally, the wellbore is formed to have a cylindrical shape, such that, the wellbore may have a circular cross-section. Alternatively, the wellbore may have any other cross-section. The wellbore may be open-hole such that the hole corresponding to the wellbore is drilled into the rock formation and subsequently, no components are arranged into the wellbore. Alternatively, the wellbore may be cased, such as, by arranging a steel casing into a drilled hole corresponding to the wellbore ("casing" is an elongate, hollow, cylindrical component that is arranged within the wellbore to conform to an internal surface of the wellbore). Subsequently, the casing can be cemented to firmly affix the casing into the wellbore. As used herein, the terms "well," "borehole," and "open-hole" when referring to an opening in the rock formation have been used interchangeably with the term "wellbore".

"Hydraulic fracturing" or "fracking" or "fracturing" refers to creating or opening fractures that extend from the wellbore into the adjacent rock formation comprising the wellbore. A fracturing fluid may be injected into the formation with sufficient hydraulic pressure to create and extend fractures, open pre-existing natural fractures, or cause slippage of faults. The fractures enable fluid flow within a geological formation that has small matrix permeability, for example, carbonate, organic-rich shale, hot-dry granite being a geothermal energy source, and the like.

"Weak plane" or "fault" refers to a rock interface or zones of interfaces that are more likely to break or slip than adjacent intact rocks under elevated stress or pressure. Depending on the composition of filling material along the rock interface, weak plane can be permeable or non-permeable to fluid flow. Examples of weak planes include natural fractures, joints, faults, and bedding planes.

"Slip" refers to the shear movement of the two interlocked or weakly bonded surfaces moving parallel to the corresponding interface. Such a slip may occur at the weak plane that acts as the rock interface parallel to which the two weakly bonded surfaces may move for occurrence of slip of fault. Shear failure criterion, such as Mohr-Coulomb failure criterion, can be used for predicting the occurrence of the slip of the fault.

"Reactivation" refers to rupture and slip between formerly interlocked or weakly bonded surfaces along the weak plane. Reactivation occurs when shear stress along the weak plane exceeds its shear strength or when pore pressure exceeds the sum of the normal stress and tensile strength along the weak plane.

Nomenclature $c_0$=Cohesion of the fault, Pa
$\sigma$=In-situ stress, Pa
$\sigma'$=Effective stress, Pa
$\sigma_1$=Maximum principle in-situ stress, Pa
$\sigma_2$=Intermediate principle in-situ stress, Pa
$\sigma_3$=Minimum principle in-situ stress, Pa
$\sigma_{min}$=Minimum principal stress perpendicular to the wellbore trajectory, Pa
$\sigma_{max}$=Maximum principal stress perpendicular to the wellbore trajectory, Pa
$\sigma_n$=Normal stress acting on the fault, Pa
$T_f$=Tensile strength of the fault, Pa
$\tau$=Shear stress, Pa
$P_p^{crit}$=Critical pore pressure during occurrence of slip of fault, Pa
$P_0$=In-situ pore pressure, Pa
$P_{bh}$=Bottom-hole pressure, Pa
$\alpha$=Biot poroelastic constant, dimensionless
$\mu$=Friction coefficient, dimensionless
$\nu$=Poisson's ratio, dimensionless FIG. 1 depicts a schematic illustration of a system 10 for producing fluids from a rock formation by injecting fluids into the rock formation, in accordance with one or more embodiments of the present disclosure. The system 10 in a rock formation 20 may include wells 30, 40, 50 and a fluid production or injection facility 60. Depending on surface constraints, geological conditions and economic prospect, a vertical well 30, a deviated well 40, or a horizontal well 50 may be drilled. Such wells 30, 40, 50 can be drilled using conventional drilling equipment, for example, commercially available well-drilling rigs. The deviated well 40 may be drilled vertically initially and then deviated towards the rock formation 20. The horizontal well 50 may be drilled using steering methods to create a wellbore that runs within and parallel along a section of the rock formation 20. The drilled wellbores may intersect one or more weak planes 70, 80, 90, that are associated with a high risk of occurrence of the slip of the fault under elevated pressure and stress during production or injection operations.

Figure 2:
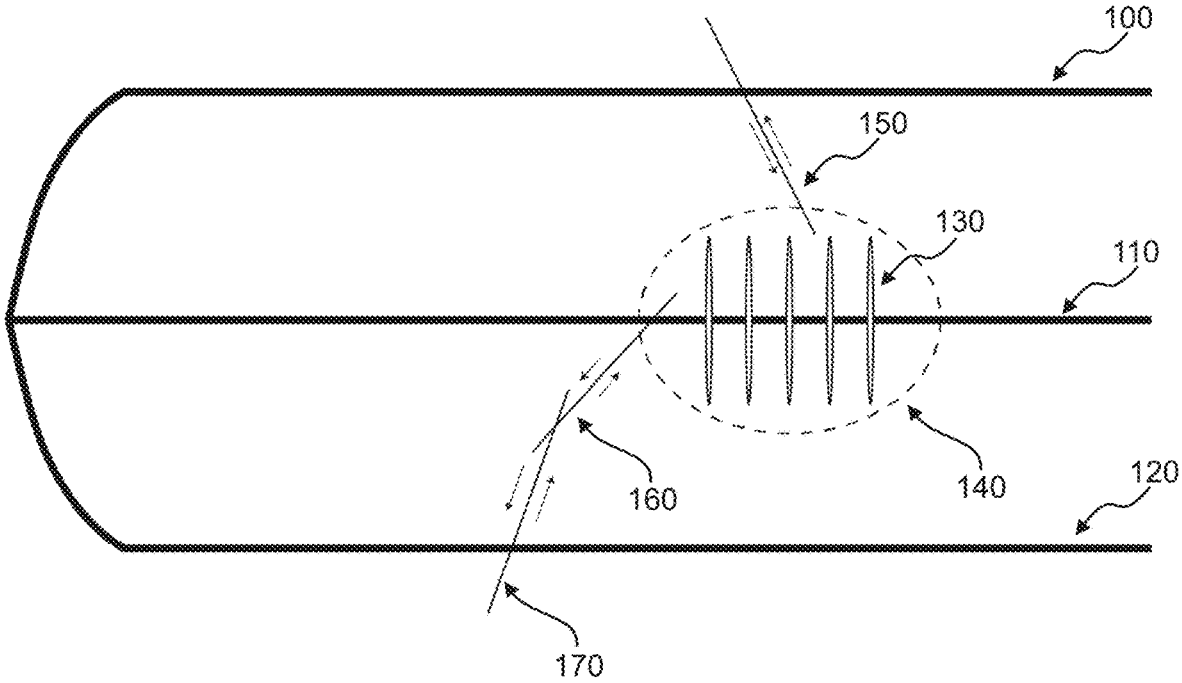
FIG. 2 depicts a schematic illustration of reactivated faults due to hydraulic fracturing operations in a well pad, in accordance with one or more embodiments of the present disclosure.

FIG. 2 depicts a schematic illustration of reactivated faults due to hydraulic fracturing operations in a well pad, in accordance with one or more embodiments of the present disclosure. As shown, multiple horizontal wells 100, 110, and 120 are drilled from a single drill site. During hydraulic fracturing, fluid is injected into horizontal well 110 to initiate and propagate one or more hydraulic fractures 130 within a section of the wellbore. Further, depending on in-situ stresses and geologic conditions, the hydraulic fracture 130 may be planar or may interact with natural fractures to form complex fracture networks within a stimulated reservoir volume 140. Pre-existing faults 150 and 160 can be reactivated by directly interacting with hydraulic fractures 130 or by the changes in stresses and fluid pressure within the stimulated reservoir volume 140. It will be appreciated that the slip of the fault 150 may cause casing damage to a casing that may be arranged within the horizontal well 100. Similarly, the slip of the fault 160 may cause casing damage to a casing arranged within the horizontal well 110. Moreover, it is possible for a fault 170 that may not be directly connected with the stimulated reservoir volume 140, to still be reactivated through other fault 160 and cause casing damage to a casing arranged within the horizontal well 120. As shown, the fault 160 intersects with the fault 170 and consequently, when the fault 160 is reactivated, it causes the slip of the fault 170.

Figure 3:
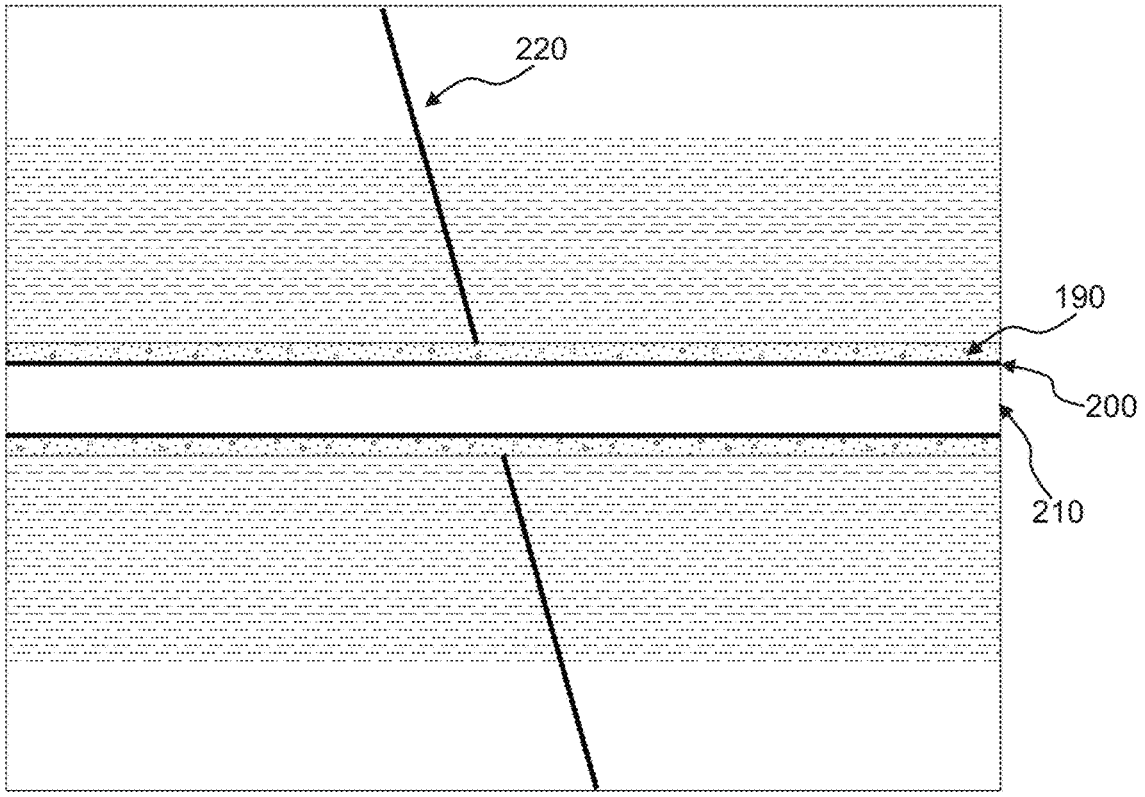
FIG. 3 depicts a schematic illustration of a cross-section of a cased and cemented wellbore that intersects with a pre-existing fault, in accordance with one or more embodiments of the present disclosure.

FIG. 3 depicts a schematic illustration of a cross-section of a cased and cemented wellbore 210 that intersects with a pre-existing fault 220, in accordance with one or more embodiments of the present disclosure. When a well is drilled through a rock formation, a portion of the well that is not cased by arrangement of a casing within the well is termed as "open-hole". Casing 200 is an elongate, hollow, cylindrical enclosure fabricated using steel that is assembled and inserted into a drilled section of the open-hole. Subsequently, the casing 200 is held in place with cement 190. In most wells, casing is indispensable and is essential for maintaining borehole stability, preventing contamination of the drinking-water aquifer, isolating different formations or well sections, and controlling well pressures during operations. A cased and cemented wellbore 210 may intersect one or more weak planes, such as a weak plane associated with pre-existing fault 220.

Because of friction and the rigidity of constituent rocks, a pre-existing fault is inactive when two surfaces corresponding to a weak plane are inter-locked (or weakly bonded) and under a state of equilibrium of stress. However, when stress is disturbed around the fault by tectonic movement and the state of equilibrium of stress is breached, the fault ruptures and slips. Consequently, strain energy accumulated between the two surfaces is released through shear movement of the two surfaces along the weak plane. Local stress and fluid pressure perturbation as a result of fluid injection or production in a rock formation may also reactivate a pre-existing fault and cause the fault to rupture and slip locally. Displacements resulting from fault reactivation may happen within a short or long-time frame. The displacements resulting from fault reactivation within the short-time frame relate, for example, to earthquakes that take place at the time of slip (called seismic fault slip). The displacements resulting from fault reactivation within the long-time frame relate, for example, to a lack of observed seismicity due to slow movement of rock bodies against each other (called aseismic fault slip).

Figure 4:
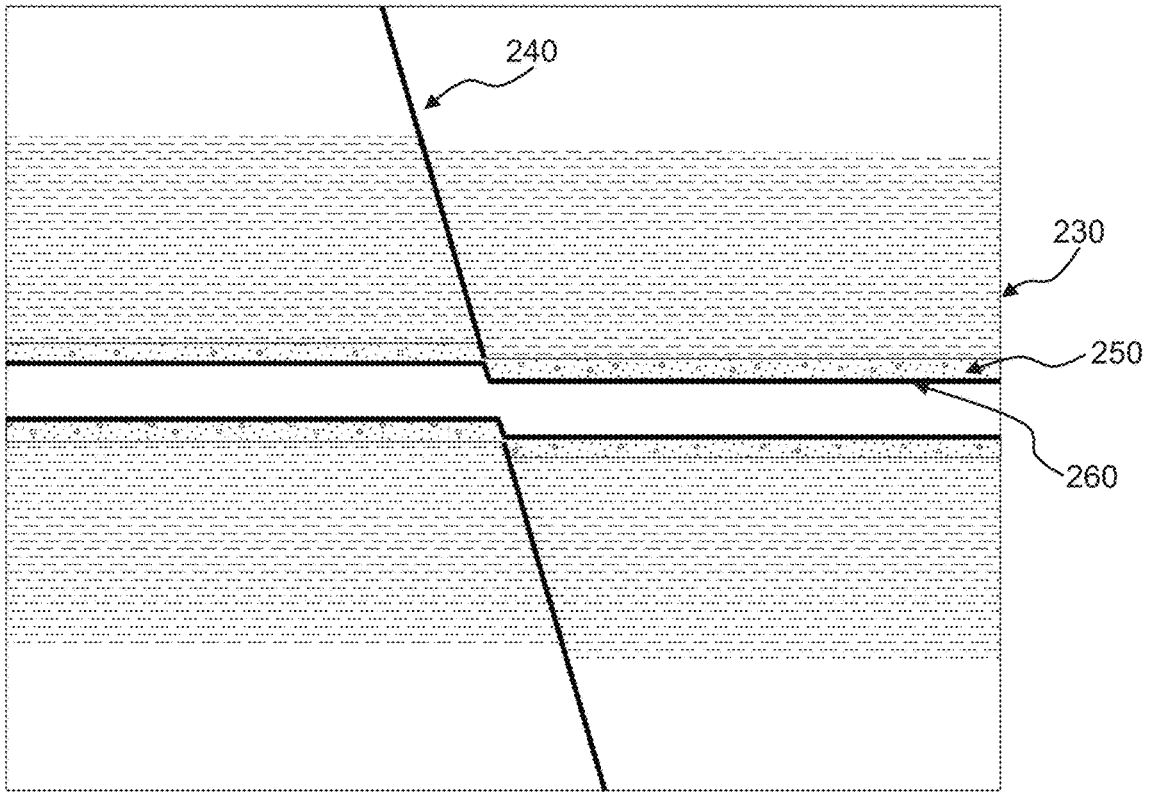
FIG. 4 depicts a schematic illustration of cross-section of fault reactivation-induced casing damage, in accordance with one or more embodiments of the present disclosure.

When a fault is reactivated either by hydraulic fracturing or injecting operations at the current treating well or at nearby wells, the slip of the fault may cause detrimental damage to the wellbore. FIG. 4 depicts a schematic illustration of cross-section of fault reactivation-induced casing damage, in accordance with one or more embodiments of the present disclosure. As shown, the rock formation 230 adjacent to fault 240 moves along weak plane corresponding to the fault 240. Then, the cement 250 and the casing 260 is squeezed and sheared along the fault 240 due to a weight of the rock formation 230 ending up on the cement 250 and the casing 260, resulting in severe casing deformation.

A first major risk associated with casing deformation includes undesired stress concentration at the deformed casing, which poses failure risks for subsequent operations throughout a lifetime of well. Distortion of wellbore geometry is a second major risk that leads to an inability of downhole tools from moving inside or passing through the casing. In some cases, such an inability of movement of the downhole tools prevents necessary downhole operations along a further portion of the wellbore. Currently, no viable method is available to remediate cemented casing after it is damaged. Thus, the portion of the wellbore that is not accessible by the downhole tools generally has to be abandoned for subsequent operations (such as, hydraulic fracturing).

Pre-Faulting and Open-Hole Remediation

As used herein, the term "pre-faulting" refers to placing a subterranean fluid into one or more open-hole wellbores extending into at least a portion of the subterranean formation, to induce one or more hydraulic fractures or shear failures. Such inducement of the one or more tensile or shear failures leads to reactivation of one or more faults. Subsequently, the section of the open-hole wellbore that is damaged by the reactivation of fault can be restored. Finally, a casing can be arranged within the restored open-hole wellbore and cemented to obtain the cased wellbore having improved integrity.

Figure 5:
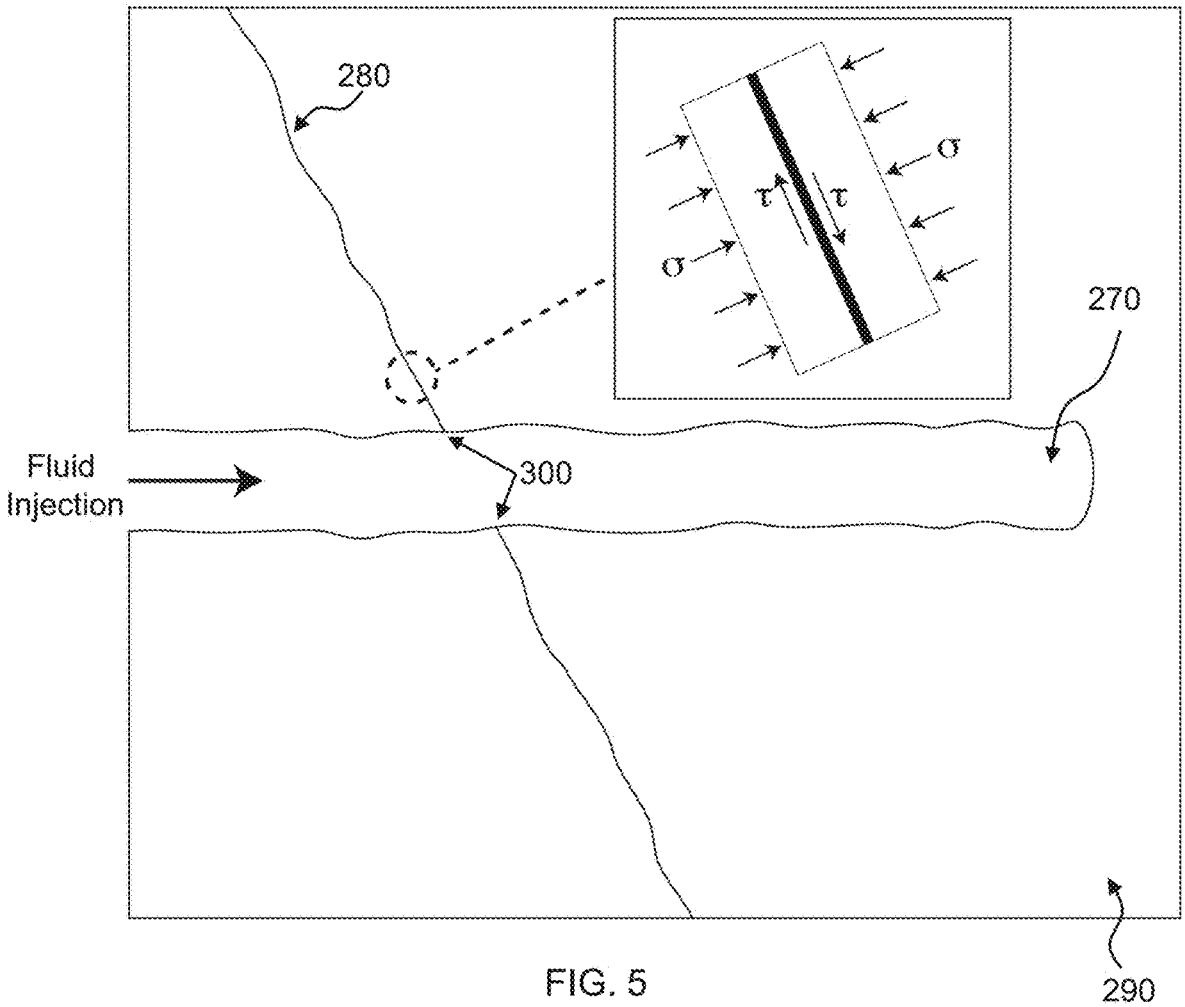
FIG. 5 depicts a schematic illustration of an open-hole that intersects with a pre-existing fault during pre-faulting, in accordance with one or more embodiments of the present disclosure.

FIG. 5 depicts a schematic illustration of an open-hole wellbore 270 that intersects with a pre-existing fault 280 during pre-faulting, in accordance with one or more embodiments of the present disclosure. As the fault 280 has lower strength than surrounding intact rock formation 290, fractures or shear failures that are induced by pressurized fluid in the open-hole wellbore 270 are more likely to initiate at the intersection 300 and subsequently, propagate along the fault 280. Eventually, fault slip will be triggered as a result of fluid invasion.

Figure 6:
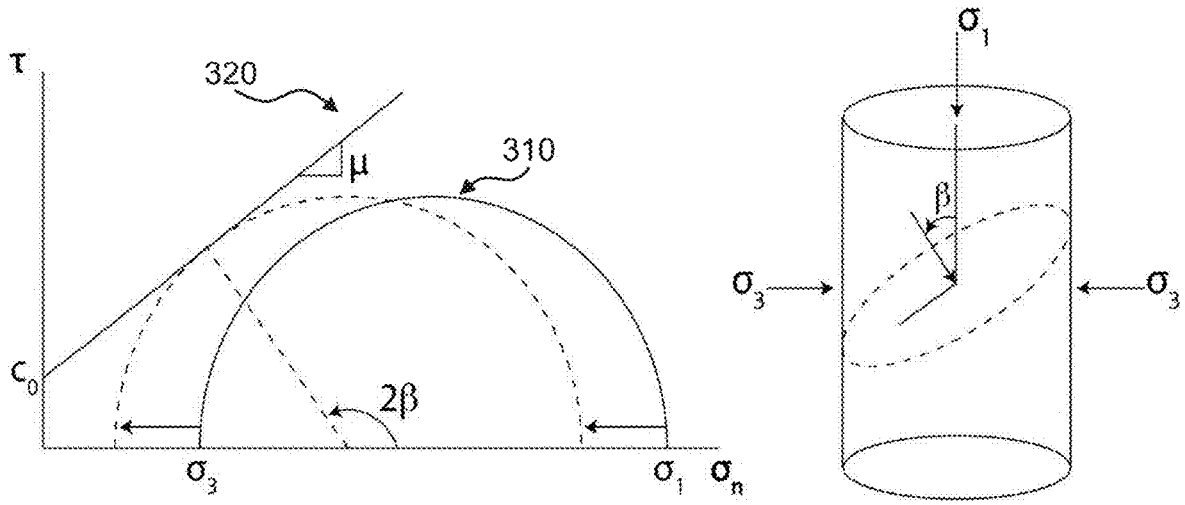
FIG. 6 depicts usage of Mohr-Coulomb failure criterion for predicting occurrence of slip of fault (or shear failure), in accordance with one or more embodiments of the present disclosure.

FIG. 6 depicts usage of Mohr-Coulomb failure criterion for predicting occurrence of slip of fault (or failure), in accordance with one or more embodiments of the present disclosure. A failure envelope 320 can be obtained through a series of tri-axial tests, as shown on right-side of FIG. 6. The failure envelope 320 delineates a linear relationship between shear stress $\tau$ and normal stress $\sigma_n$ acting on a fracture plane when the sample fails. The mathematical expression of the failure envelope 320 is as follows:

$$\tau = c_0 + \sigma_n \mu \tag{1}$$

Experimental testing and field observations found that friction coefficient of fault typically varies between 0.6 and 0.85; a low friction coefficient of 0.2 has also been reported for clay material in available literature.

Mohr circle 310 representing the stress state is constructed by the maximum principal stress $\sigma_1$ and minimum principal stress $\sigma_3$. If any point along the Mohr circle 310 touches the failure envelope 320, the rock sample will fail and slip along the fracture. For a fluid-saturated rock in the subterranean formation, stresses used in the Mohr-Coulomb failure criterion are the effective stresses given by:

$$\sigma' = \sigma - \sigma P_0 \tag{2}$$

When pore pressure increases, the Mohr circle 310 will shift towards the failure envelope 320 as effective normal stresses are reduced. Therefore, elevating pore pressure promotes the slip of the fault.

For using Mohr-Coulomb failure criterion to predict the occurrence of the slip of the fault in three-dimensional space, shear stress and normal stress acting on the fault plane have to be calculated through a series of stress tensor transformations, as shown in FIG. 7. Typically, vertical stress, minimum horizontal stress and maximum horizontal stress constitute the three in-situ principal stresses. The orientation of a fault plane is often characterized by its strike and dip angle on a geologic map. Knowing the three principal stresses and the orientation of the fault, the normal and shear stress acting on the fault can be quantified through stress tensor transformations. Based on the Mohr-Coulomb failure criterion, the pore pressure inside the fault has to reach or exceed a critical pore pressure to trigger the slip of the fault. Once the normal and shear stress acting on the fault are calculated, the critical pore pressure can be determined as:

$$P_p^{crit} = \sigma_n - \frac{\tau - c_0}{\mu} \tag{3}$$

During pre-faulting operations, the reactivated fault may initially rupture and break because of tensile failure induced by the pressurized fluid within the open-hole wellbore. However, as the pressurized fluid infiltrates into the fault and induces hydraulic fractures to increase the pore pressure inside the fault, the slip of the fault occurs eventually. The bottom-hole pressure required to initiate a tensile fracture along the fault zone in an open-hole wellbore can be determined from continuum mechanics using Kirsch equations. For impermeable formations, the bottom-hole pressure has to satisfy:

$$P_{bh} \geq 3\sigma_{min} - \sigma_{max} - P_0 \pm T_f \tag{4}$$

For permeable formations, the bottom-hole pressure has to satisfy:

$$P_{bh} \geq \frac{3\sigma_{min} - \sigma_{max} - \alpha\left(\frac{1-2\upsilon}{2-\upsilon}\right)P_0 + T_f}{2 - \alpha\left(\frac{1-2\upsilon}{2-\upsilon}\right)} \tag{5}$$

Equations 4 and 5 represent the bottom-hole pressure required to initiate a fracture in an open-hole wellbore through tensile failure in impermeable and permeable formations.

FIG. 8 depicts a schematic illustration of a cross-section of a slip of a fault 330 due to pre-faulting in an open-hole 340 within a rock formation 350, in accordance with one or more embodiments of the present disclosure. The slip of the fault 330 cuts through the open-hole 340 and distorts a path of the wellbore with an offset between two sides of the reactivated fault 330. This offset can be identified by the distance between the axial lines 360, 370 on each side of the wellbore. This offset reduces the wellbore cross-section area inside casing and becomes an obstruction when moving tools inside the casing.

Intentionally reactivating faults through pre-faulting operations, in temporary open-hole wellbore before the casing is arranged and cemented within has two main advantages. A first advantage comprises increasing stability of the faults once the stored elastic energy is released during pre-faulting. Thus, the faults are less likely to slip further during subsequent hydraulic fracturing operations after the casing is cemented. A second advantage is that even though pre-faulting may impair the wellbore trajectory and increase its tortuosity along the weak plane, it is more practical and economically viable to remediate and restore a section of open-hole wellbore than a cased wellbore. This is because the deformed steel casing is too costly to enlarge and remediate in the subsurface.

Revising fracturing design and modifying wellbore trajectory have minimal effect on mitigating casing damage because they cannot prevent the rupture and slip of weak planes during hydraulic fracturing operations, in particular, when the fault is close to or situated in an unstable state with substantial amount of elastic energy stored in the near-fault region.

Depending on location and density of faults, pre-faulting can be conducted at a single well having a plurality of sections or through the whole wellbore. Pre-faulting can also be performed for multiple wells of a same pad in a sequential or simultaneous manner. It will be appreciated that pre-faulting one well may reactivate a distant fault that intercepts a nearby well because of an interaction between the fault and induced hydraulic fractures. Downhole devices, such as perforating guns, notch tools, may be used to promote hydraulic fracture initiation from or near faults. Materials such as diverting particles or proppants may be added during the pre-faulting operations to promote reactivation of multiple faults along the wellbore. Real-time monitoring techniques may be used to diagnose progress and results of pre-faulting operations.

After fault reactivation, the well may be shut-in for an extended period of time, during which time, pressure at the surface or downhole is measured. The pressure and time data from one or more wells may be analyzed to estimate the formation and fault properties (such as in-situ stress, permeability, pore pressure, and so forth) by using standard or ad-hoc pressure transient analysis that is commonly used in oil and gas industry.

The tortuosity and offset of an open-hole wellbore that resulted from pre-faulting may obstruct a process of passing a casing string through the open-hole wellbore (or casing tripping). Further, if the cross-sectional area of wellbore near the reactivated fault is too small or too aspheric, the casing will not pass through the wellbore. Downhole devices such as milling or reaming tools may be used to enlarge and smoothen the open-hole wellbore after or during pre-faulting operations.

Figure 9:
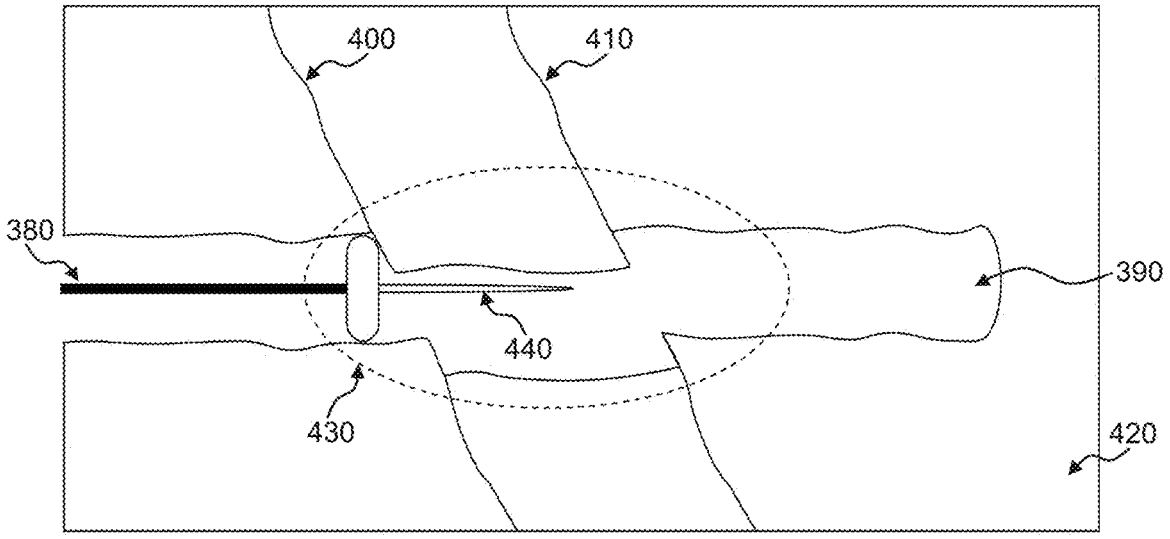
FIG. 9 depicts a schematic illustration of a milling tool running inside an open-hole that has been pre-faulted, in accordance with one or more embodiments of the present disclosure.

FIG. 9 depicts a schematic illustration of a milling tool 380 running inside an open-hole wellbore 390 that has been pre-faulted, in accordance with one or more embodiments of the present disclosure. Two faults 400 and 410 were reactivated during pre-faulting operations. As shown, the rock formation 420 due to being in between the faults 400 and 410, moved along with a reactivated portion of the rock formation 420 and distorted a path of a section 430 of the open-hole wellbore 390. The milling tool 380 may be tripped (such as, consecutively moved forwards and backwards) to downhole through drill string or coiled tubing. Consequently, the milling tool 380 is able to cut, crush and smooth out any obstacles along the designed wellbore trajectory. To remediate an open-hole wellbore 390 that has a large offset due to the slip of the fault, the milling tool 380 may have a self-guiding arrangement (for example, an extended rod 440 in front of the milling tool 380) that can ensure that the milling tool 380 moves along the original wellbore trajectory. Such a self-guiding arrangement also allows to avoid drilling a new wellbore deviated away from the original wellbore. In addition, the open-hole wellbore's diameter may be enlarged by the milling tool 380 as required for specific engineering purposes.

Figure 10:
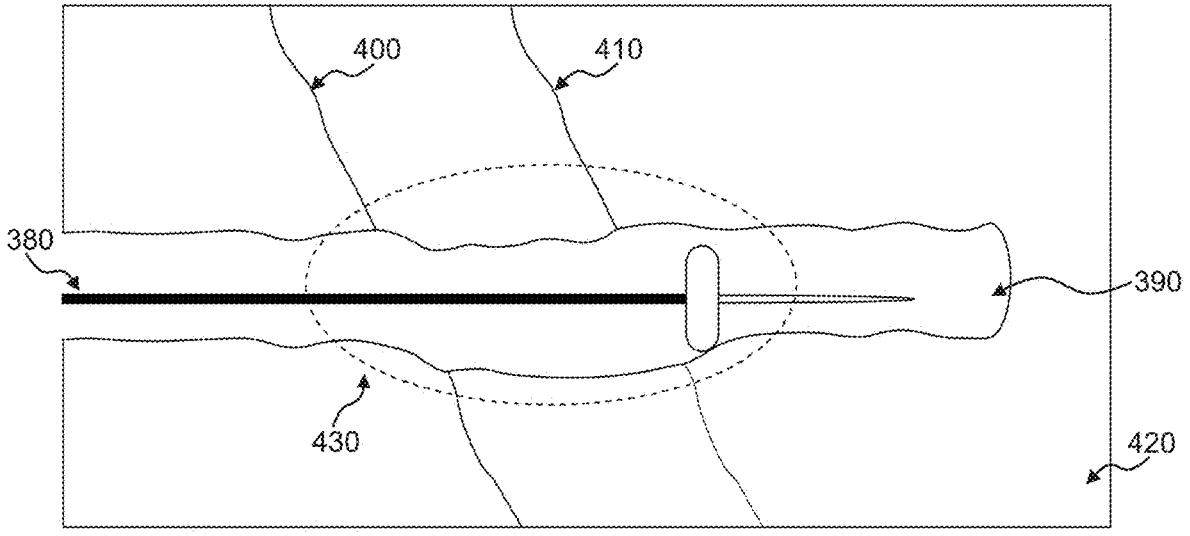
FIG. 10 depicts a schematic illustration of a pre-faulted open-hole wellbore that has been restored by a milling tool, in accordance with one or more embodiments of the present disclosure.

FIG. 10 depicts a schematic illustration of a pre-faulted open-hole wellbore 390 that has been remediated by a milling tool 380, in accordance with one or more embodiments of the present disclosure. The distorted section 430 of wellbore trajectory near the reactivated faults 400 and 410 is restored by smoothing and enlarging the wellbore, such that subsequent casing and cementing operations can be executed.

Methods of restoring distorted open-hole after pre-faulting is not limited to the mechanical methods, such as using milling or reaming tools. Other methods like water jet, gas jet, high power laser, and the like can also be used to remediate and smoothen open-hole wellbore by cutting and breaking rock formations, to enable casing or passing downhole tools through the wellbore.

Pre-faulting is different from open-hole hydraulic fracture (OHF). OHF aims to enhance a productivity of an open-hole wellbore that has no cemented casing in place. As a purpose of OHF relates to production enhancement, proppants are added in an injection fluid used during OHF, to keep the hydraulic fracture open during production. Further, high pressure is needed to create enough fracture width to transport proppants during injection. In addition, the reactivation of fault is avoided as much as possible for OHF, to avoid a diversion of hydraulic fracturing fluid, contamination of other formations and to keep hydraulic fractures contained within desired formation layers and regions. On the contrary, pre-faulting is a pre-conditioning of the wellbore-fault system and is used in conjunction with open-hole remediation and traditional cased-hole completion procedures. Reactivation of fault is a primary intention of pre-faulting. After pre-faulting, it is still needed to arrange the casing within the wellbore and cement the casing, perforate the cased wellbore and perform hydraulic fracturing within the rock formation comprising the wellbore. Pre-faulting is an active and preventative approach to stabilize the weak planes by purposely releasing accumulated elastic energy in the rock formation.

Figure 11:
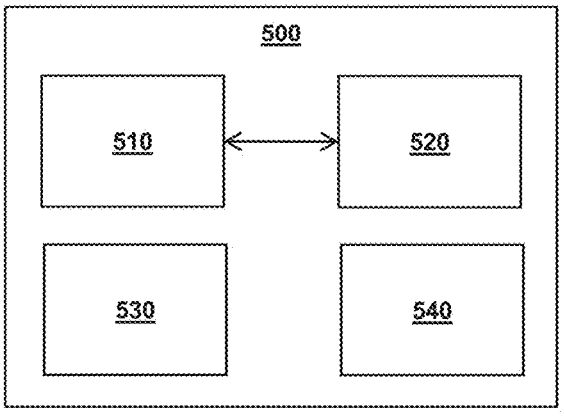
FIG. 11 is a block diagram of a system for improving integrity of a cased wellbore, in accordance with one or more embodiments of the present disclosure.

FIG. 11 is a block diagram of a system 500 for improving integrity of a cased wellbore, in accordance with one or more embodiments of the present disclosure. The system 500 comprises a data storing arrangement 510 configured to store information corresponding to at least one weak plane within the open-hole wellbore. The data storing arrangement 510 can be implemented as a computer-usable, or computer-readable, storage medium (including a storage device associated with a computing device), for example, but is not limited to, an electronic, magnetic, optical, electromagnetic, infrared, or semiconductor system, apparatus, device, or any suitable combination of the foregoing. More specific examples (a non-exhaustive list) of the computer-readable medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a digital versatile disk (DVD), a static random access memory (SRAM), a memory stick, a floppy disk, a mechanically encoded device such as punch-cards or raised structures in a groove having instructions recorded thereon, a media such as those supporting the internet or an intranet, or a magnetic storage device. Note that the computer-usable or computer-readable medium could even be a suitable medium upon which the program is stored, scanned, compiled, interpreted, or otherwise processed in a suitable manner, if necessary, and then stored in a computer memory. In the context of the present disclosure, a computer-usable or computer-readable, storage medium may be any tangible medium that can contain or store a program for use by or in connection with the instruction execution system, apparatus, or device.

The system 500 further comprises a data processing arrangement 520 communicatively coupled to the data storing arrangement 510. The data processing arrangement 520 can be implemented as any device capable of performing operations, such as a dedicated processor, a portion of a processor, a virtual processor, a portion of a virtual processor, portion of a virtual device, or a virtual device. In some implementations, a processor may be a physical processor or a virtual processor. In some implementations, a virtual processor may correspond to one or more parts of one or more physical processors. In some implementations, the instructions/logic may be distributed and executed across one or more processors, virtual or physical, to execute the instructions/logic. The data processing arrangement 520 is configured to receive information corresponding to at least one weak plane within the open-hole wellbore from the data storing arrangement 510 and identify at least one weak plane corresponding to a highest probability of a slip of a fault within the open-hole wellbore. The system 500 also comprises a fluid injection facility 530 (such as, the fluid injection facility 60 depicted in FIG. 1) configured to provide pressurized fluid into the open-hole wellbore to cause the slip of the fault by inducing tensile or shear failures within the open-hole wellbore along the at least one weak plane. The system 500 further comprises a material-removal device 540 (such as the milling tool 380 depicted in FIG. 9) configured to restore a shape of the open-hole wellbore after the slip of the fault by removing material from an inner surface of the open-hole wellbore, to provide a uniform or smooth cross-section along an elongate axis of the open-hole wellbore.

In one or more embodiments, the open-hole wellbore is a horizontal wellbore or a deviated wellbore having a non-vertical portion. In one or more embodiments, the data processing arrangement 520 is further configured to predict an occurrence of the slip of the fault within the open-hole wellbore. In one or more embodiments, the data processing arrangement 520 is configured to predict the occurrence of the slip of the fault by identifying a shear strength along the at least one weak plane. Further, the data processing arrangement 520 is configured to determine a shear stress applied along the at least one weak plane. The data processing arrangement 520 is also configured to determine the shear stress to be equal to or more than the shear strength for predicting the occurrence of the slip of the fault along the at least one weak plane.

In one or more embodiments, the data processing arrangement 520 is configured to use shear failure criterion comprising Mohr-Coulomb failure criterion, for predicting the occurrence of the slip of the fault by identifying a critical pore pressure along the at least one weak plane and determining a pore pressure applied along the at least one weak plane. Further, the data processing arrangement 520 is configured to determine the pore pressure to be equal to or more than the critical pore pressure for predicting the occurrence of the slip of the fault along the at least one weak plane. In one or more embodiments, the fluid injection facility 530 comprises at least one of a perforating gun or a notch tool.

In one or more embodiments, the material-removal device 540 is configured to restore the shape of the open-hole wellbore by performing consecutive forward and backward motions along the elongate axis of the open-hole wellbore.

In one or more embodiments, the data processing arrangement 520 is further configured to determine an offset between the elongate axis of the open-hole wellbore and an axis corresponding to a distortion caused by the slip of the fault.

In one or more embodiments, the material-removal device 540 is configured to restore the shape of the open-hole wellbore by reducing the offset between the elongate axis of the open-hole wellbore and the axis corresponding to the distortion caused by the slip of the fault. In one or more embodiments, the material-removal device 540 comprises at least one of a milling device, a reaming device, a water-jet device, a gas-jet device or a high-power laser. In one or more embodiments, the material-removal device 540 is arranged with a self-guiding arrangement for allowing steady movement of the material-removal device within the open-hole wellbore along a planned trajectory. In one or more embodiments, the material-removal device 540 is further configured to enlarge a diameter of the open-hole wellbore after restoring the shape of the open-hole wellbore.

Figure 12:
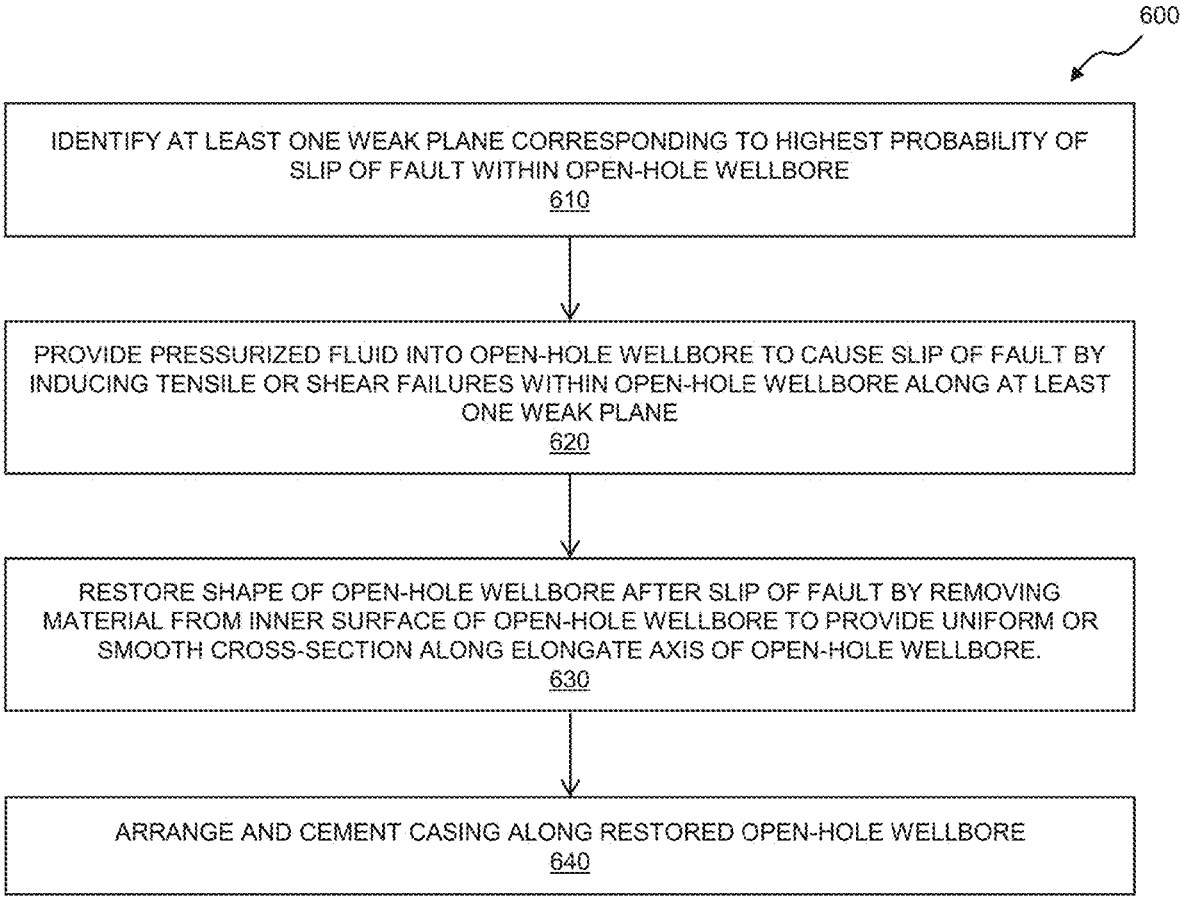
FIG. 12 is an illustration of steps of a method for improving integrity of a cased wellbore, in accordance with one or more embodiments of the present disclosure.

FIG. 12 is an illustration of steps of a method 600 for improving integrity of a cased wellbore, in accordance with one or more embodiments of the present disclosure. At a step 610, at least one weak plane corresponding to a highest probability of a slip of a fault within the open-hole wellbore is identified. At a step 620, pressurized fluid is provided into the open-hole wellbore to cause the slip of the fault by inducing tensile or shear failures within the open-hole wellbore along the at least one weak plane. At a step 630, a shape of the open-hole wellbore is restored after the slip of the fault by removing material from an inner surface of the open-hole wellbore, to provide a uniform or smooth cross-section along an elongate axis of the open-hole wellbore. At a step 640, a casing is arranged and cemented in the restored open-hole wellbore to obtain the cased wellbore having improved integrity.

Further, provided is a computer program product comprising one or more computer readable hardware storage devices having computer readable program code stored therein, said program code containing instructions executable by one or more processors of a computer system to implement a method for improving integrity of a cased wellbore. The method comprises identifying at least one weak plane corresponding to a highest probability of a slip of a fault within the open-hole wellbore and providing pressurized fluid into the open-hole wellbore to cause the slip of the fault by inducing tensile or shear failures within the open-hole wellbore along the at least one weak plane. The method further comprises restoring a shape of the open-hole wellbore after the slip of the fault by removing material from an inner surface of the open-hole wellbore, to provide a uniform or smooth cross-section along an elongate axis of the open-hole wellbore. The method also comprises arranging and cementing a casing in the restored open-hole wellbore to obtain the cased wellbore having improved integrity.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A method for improving integrity of a cased wellbore, the method comprising:

identifying at least one weak plane corresponding to a highest probability of a slip of a fault within an open-hole wellbore;

providing pressurized fluid into the open-hole wellbore to cause the slip of the fault by inducing tensile or shear failures within the open-hole wellbore along the at least one weak plane;

restoring a shape of the open-hole wellbore after the slip of the fault by removing material from an inner surface of the open-hole wellbore, to provide a uniform or smooth cross-section along an elongate axis of the open-hole wellbore; and arranging and cementing a casing along the restored open-hole wellbore to obtain the cased wellbore having improved integrity.

2. The method as claimed in claim 1, wherein the open-hole wellbore is a horizontal wellbore or a deviated wellbore having a non-vertical portion.

3. The method as claimed in claim 1, further comprising predicting an occurrence of the slip of the fault within the open-hole wellbore.

4. The method as claimed in claim 3, further comprising:

identifying a shear strength along the at least one weak plane;

determining a shear and normal stress applied along the at least one weak plane; and determining the shear stress to be equal to or more than the shear strength for predicting the occurrence of the slip of the fault along the at least one weak plane.

5. The method as claimed in claim 3, further comprising using shear failure criterion comprising Mohr-Coulomb failure criterion, for predicting the occurrence of the slip of the fault by:

identifying a critical pore pressure along the at least one weak plane;

determining a pore pressure applied along the at least one weak plane; and determining the pore pressure to be equal to or more than the critical pore pressure for predicting the occurrence of the slip of the fault along the at least one weak plane.

6. The method as claimed in claim 1, further comprising determining an offset between the elongate axis of the open-hole wellbore and an axis corresponding to a distortion caused by the slip of the fault.

7. The method as claimed in claim 6, wherein restoring the shape of the open-hole wellbore comprises reducing the offset between the elongate axis of the open-hole wellbore and the axis corresponding to the distortion caused by the slip of the fault.

8. A system for improving integrity of a cased wellbore, the system comprising:

a data storing arrangement configured to store information corresponding to at least one weak plane within an open-hole wellbore;

a data processing arrangement communicatively coupled to the data storing arrangement and configured to:

receive information corresponding to the at least one weak plane within the open-hole wellbore from the data storing arrangement; and identify the at least one weak plane corresponding to a highest probability of a slip of a fault within the open-hole wellbore;

a fluid injection facility configured to provide pressurized fluid into the open-hole wellbore to cause the slip of the fault by inducing tensile or shear failures within the open-hole wellbore along the at least one weak plane;

a material-removal device configured to restore a shape of the open-hole wellbore after the slip of the fault by removing material from an inner surface of the open-hole wellbore, to provide a uniform or smooth cross-section along an elongate axis of the open-hole wellbore; and a device for arranging and cementing a casing along the restored open-hole wellbore to obtain the cased wellbore having improved integrity.

9. The system as claimed in claim 8, wherein the open-hole wellbore is a horizontal wellbore or a deviated wellbore having a non-vertical portion.

10. The system as claimed in claim 8, wherein the data processing arrangement is further configured to predict an occurrence of the slip of the fault within the open-hole wellbore.

11. The system as claimed in claim 10, wherein the data processing arrangement is configured to predict the occurrence of the slip of the fault by:

identifying a shear strength along the at least one weak plane;

determining a shear and normal stress applied along the at least one weak plane; and determining the shear stress to be equal to or more than the shear strength for predicting the occurrence of the slip of the fault along the at least one weak plane.

12. The system as claimed in claim 10, wherein the data processing arrangement is configured to use shear failure criterion comprising Mohr-Coulomb failure criterion, for predicting the occurrence of the slip of the fault by:

identifying a critical pore pressure along the at least one weak plane;

determining a pore pressure applied along the at least one weak plane; and determining the pore pressure to be equal to or more than the critical pore pressure for predicting the occurrence of the slip of the fault along the at least one weak plane.

13. The system as claimed in claim 8, wherein the fluid injection facility comprises at least one of a perforating gun or a notch tool.

14. The system as claimed in claim 8, wherein the material-removal device is configured to restore the shape of the open-hole wellbore by performing consecutive forward and backward motions along the elongate axis of the open-hole wellbore.

15. The system as claimed in claim 8, wherein the data processing arrangement is further configured to determine an offset between the elongate axis of the open-hole wellbore and an axis corresponding to a distortion caused by the slip of the fault.

16. The system as claimed in claim 15, wherein the material-removal device is configured to restore the shape of the open-hole wellbore by reducing the offset between the elongate axis of the open-hole wellbore and the axis corresponding to the distortion caused by the slip of the fault.

17. The system as claimed in claim 8, wherein the material-removal device comprises at least one of a milling device, a reaming device, a water-jet device, a gas-jet device or a high-power laser.

18. The system as claimed in claim 17, wherein the material-removal device is arranged with a self-guiding arrangement for allowing steady movement of the material-removal device within the open-hole wellbore along a planned trajectory.

19. The system as claimed in claim 8, wherein the material-removal device is further configured to enlarge a diameter of the open-hole wellbore after restoring the shape of the open-hole wellbore.

20. A computer program product, comprising one or more computer readable hardware storage devices having computer readable program code stored therein, said program code containing instructions executable by one or more processors of a computer system to implement a method for improving integrity of a cased wellbore, the method comprising:

identifying at least one weak plane corresponding to a highest probability of a slip of a fault within an open-hole wellbore;

providing pressurized fluid into the open-hole wellbore to cause the slip of the fault by inducing tensile or shear failures within the open-hole wellbore along the at least one weak plane;

restoring a shape of the open-hole wellbore after the slip of the fault by removing material from an inner surface of the open-hole wellbore, to provide a uniform or smooth cross-section along an elongate axis of the open-hole wellbore; and arranging and cementing a casing along the restored open-hole wellbore to obtain the cased wellbore having improved integrity.

* * * * *